US006033255A

United States Patent [19]

Murofushi

[11] Patent Number: 6,033,255

[45] Date of Patent: Mar. 7, 2000

[54] PRESS-CONNECTING TERMINAL

[75] Inventor: Satoru Murofushi, Shizuoka, Japan

[73] Assignee: Yazaki Corporation, Tokyo, Japan

[21] Appl. No.: 09/026,478

[22] Filed: Feb. 19, 1998

[30] Foreign Application Priority Data

Feb. 19, 1997 [JP] Japan ..... 9-035018

[51] Int. Cl.[7] ..... H01R 4/24

[52] U.S. Cl. ..... 439/397; 439/387

[58] Field of Search ..... 439/397, 398, 439/399, 401, 402, 403–7, 851, 856

[56] References Cited

U.S. PATENT DOCUMENTS

| | | | |
|---|---|---|---|
| 4,427,251 | 1/1984 | Mathe et al. | 339/97 R |
| 4,768,975 | 9/1988 | Chupak et al. | 439/397 |
| 4,772,234 | 9/1988 | Cooper | 439/851 |
| 5,030,143 | 7/1991 | Hatagishi | 439/861 |
| 5,879,181 | 3/1999 | Okabe | 439/397 |

FOREIGN PATENT DOCUMENTS 60-134284 9/1985 Japan .

*Primary Examiner*—Lincoln Donovan
*Attorney, Agent, or Firm*—Sughrue, Mion, Zinn, Macpeak & Seas, PLLC

[57] ABSTRACT

A press-connecting terminal provided with a press-connecting portion having a pair of press-connecting blades which are cut and bent toward a space between a pair of opposed sidewalls and face each other with a predetermined gap held therebetween into which a covered electric wire is pressed, and a contact portion whose width is set to be larger than a width between the sidewalls of the press-connecting portion and which is to be connected to a mating terminal. The press-connecting terminal is accommodated in a terminal accommodating groove which is formed in a housing and whose inside width is set to be substantially equal to the width of the contact portion. Positioning projections for placing the press-connecting portion in a predetermined position in the width direction of the terminal accommodating groove are provided in the press-connecting portion.

3 Claims, 6 Drawing Sheets

PRESS-CONNECTING TERMINAL

BACKGROUND OF THE INVENTION

1. Field of the Invention

The present invention relates to a press-connecting terminal which is connected to a covered electric wire by pressing the covered electric wire into a gap between a pair of press-connecting blades.

2. Description of the Related Art

FIG. 5 shows a press-connecting terminal 1 similar to what is described in Japanese Utility Model Unexamined Publication No. Sho. 60-134284. The press-connecting terminal 1 incorporates a contact portion 2 which is formed on one side of the terminal and to be connected to a mating terminal, and an electric wire joint 3 which is formed on the other side thereof. The electric wire joint 3 is provided with an electric-wire holding portion 4 on the rear side of the electric wire joint 3, and a press-connecting portion 5 is provided between the electric-wire holding portion 4 and the contact portion 2.

The press-connecting portion 5 is formed with three sets of pairs of press-connecting blades 7, 7, the pair of press-connecting blades 7, 7 being substantially perpendicularly cut and bent toward a space between sidewalls 6, 6, and the pair of press-connecting blades 7, 7 facing each other with a predetermined gap held therebetween. A covered electric wire (see FIG. 7) 8 is pressed into a gap between the press-connecting blades 7, 7, and a covering portion 9 of the covered electric wire 8 is ruptured by the press-connecting blades 7, 7, so that a conductor portion (see FIG. 7) 10 of the covered electric wire 8 and the press-connecting blades 7, 7 are brought into contact with each other and electrically connected.

The width L2 between the sidewalls 6, 6 is set to be smaller than the width L1 of the contact portion 2 of the press-connecting terminal 1.

The reason for this is that the width L1 of the contact portion 2 of the press-connecting terminal 1 to be connected to the end portion of the covered electric wire 8 needs to be not less than twice as large as the external diameter L3 of the covered electric wire 8 which is usually employed in view of the necessity of securing sufficient reliability of electrical connection with the mating terminal.

On the other hand, the press-connecting portion 5 for use in press-connecting the end portion of the covered electric wire 8 needs to ensure that the conductor portion 10 of the covered electric wire 8 is brought into contact with the press-connecting terminal 1 while clamped with the pair of press-connecting blades 7, 7. Therefore, the inside width between the sidewalls 6, 6 where the press-connecting blades 7, 7 are formed by cutting and bending needs to be equal to or smaller than the external diameter of the covered electric wire 8.

Consequently, the width L2 between the sidewalls 6, 6 (width of the press-connecting portion 5) is set to be smaller than the width L1 of the contact portion 2.

As shown in FIG. 6, moreover, the press-connecting terminal 1 is accommodated in a terminal accommodating groove 12 formed in a housing 11 of, for example, a connector. In this case, the inside width L4 of such a terminal accommodating groove 12 is set in conformity with the width L1 of the contact portion 2 where the width of the press-connecting terminal 1 is maximized.

As shown in FIG. 7, further, the end portion of the covered electric wire 8 is placed between the sidewalls 6, 6 of the press-connecting portion 5 while the press-connecting terminal 1 is housed in the terminal accommodating groove 12, and press-fitted in between the press-connecting blades 7, 7 by means of a press-connecting jig 13, whereupon the conductor portion 10 is brought into contact with the press-connecting blades 7, 7 as the covering portion 9 of the covered electric wire 8 is ruptured by the press-connecting blades 7, 7. Thus, the press-connecting terminal 1 is connected to the end portion of the covered electric wire 8.

However, since the width L1 of the press-connecting portion 5 is narrower than the width L2 of the contact portion 2 as shown in FIG. 6, the side of the press-connecting portion 5 of the press-connecting terminal 1 becomes shaky (in a direction of an arrow a) around the side of the contact portion 2 in the terminal accommodating groove 12. Consequently, the position of the press-connecting portion 5 in the terminal accommodating groove 12 tends to become undeterminable and thus unstable.

The press-connecting jig 13 interferes with the press-connecting terminal 1 because the press-connecting portion 5 is shifted from the press-connecting jig 13 so positioned as to be in agreement with the center of the terminal accommodating groove 12 as shown in FIG. 7 and this results in nonconformity, for example, deforming and damaging the press-connecting terminal 1.

SUMMARY OF THE INVENTION

An object of the present invention is to provide a press-connecting terminal which can be properly positioned in a terminal accommodating groove and is also free from a backlash in the terminal accommodating groove.

In order to accomplish the above object, according to the present invention, there is provided a press-connecting terminal which is to be accommodated in a terminal accommodating groove formed in a housing, the press-connecting terminal comprising: a press-connecting portion having a pair of press-connecting blades which are cut and bent toward a space between a pair of opposed sidewalls and face each other with a predetermined gap held therebetween into which a covered electric wire is pressed; a contact portion whose width is set to be larger than a width between the sidewalls of the press-connecting portion and which is to be connected to a mating terminal, the width of the contact portion being substantially equal to an inside width of the terminal accommodating groove of the housing; and a positioning projection provided in the press-connecting portion for placing the press-connecting portion in a predetermined position in a width direction of the terminal accommodating groove.

BRIEF DESCRIPTION OF THE DRAWINGS

FIG. 1(*b*) is a sectional view showing the same;

FIG. 2(*b*) is a plan view showing the same;

FIG. 2(*c*) is a sectional view showing the same, taken along line C—C of FIG. 2(*b*);

FIG. 3(*b*) is a partially exploded plan view of the same, in such a state that the press-connecting terminal is accommodated in the terminal accommodating groove;

DETAILED DESCRIPTION OF THE PREFERRED EMBODIMENTS

Figure 1A:
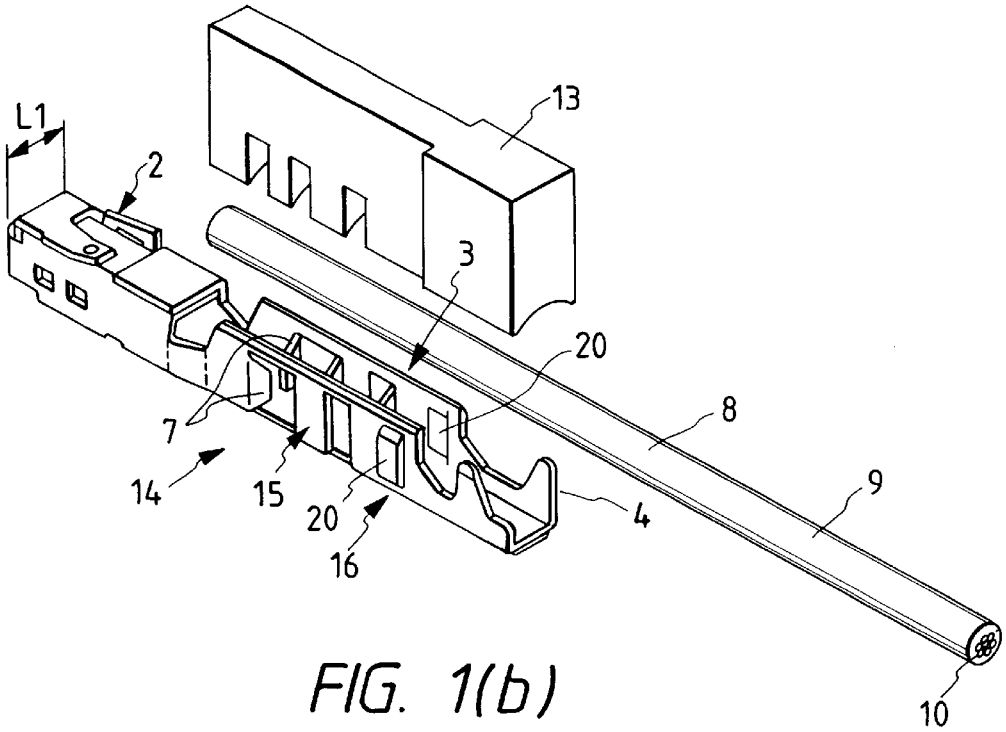
FIG. 1(*a*) is a perspective view showing the relation between a press-connecting terminal according to the present invention and a press-connecting jig.
Figure 1B:
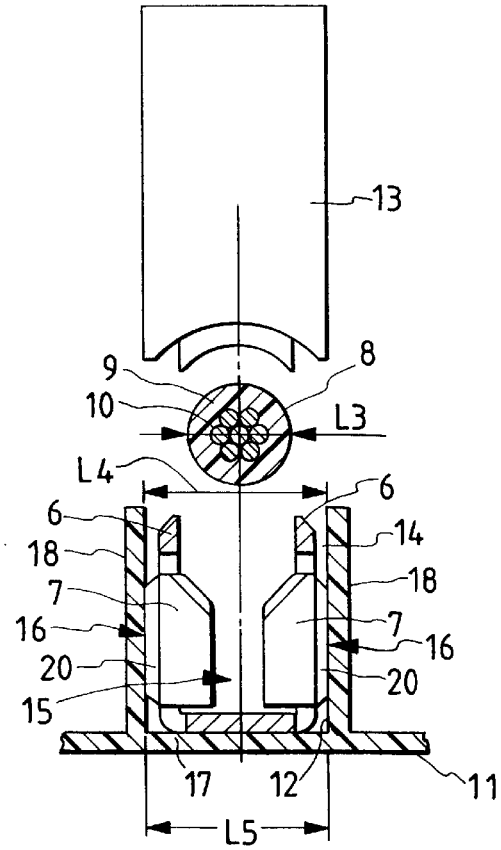
Figure 2A:
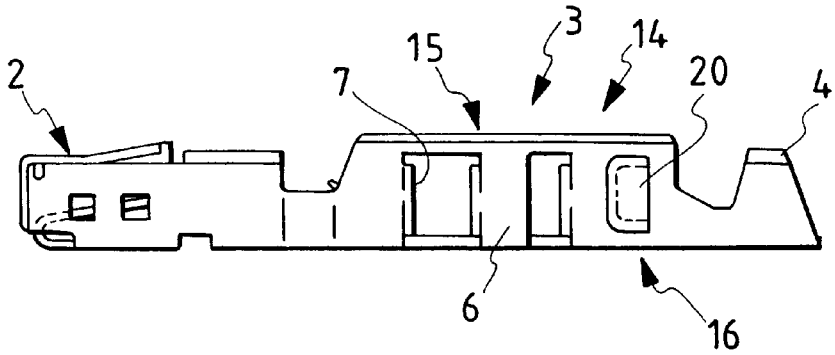
FIG. 2(*a*) is a side view showing the press-connecting terminal according to the present invention.
Figure 2B:
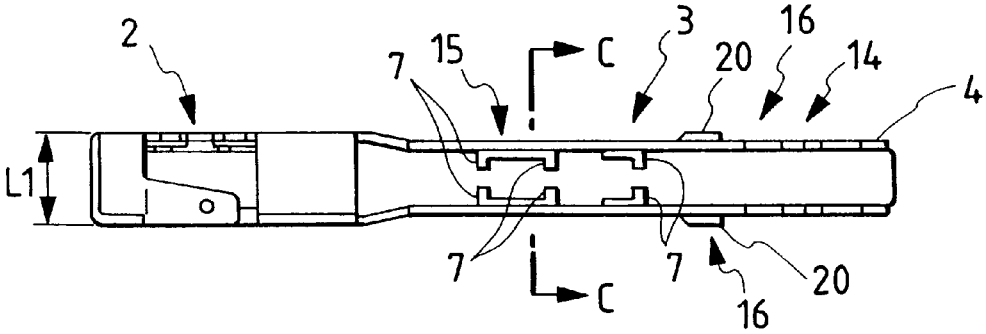
Figure 2C:
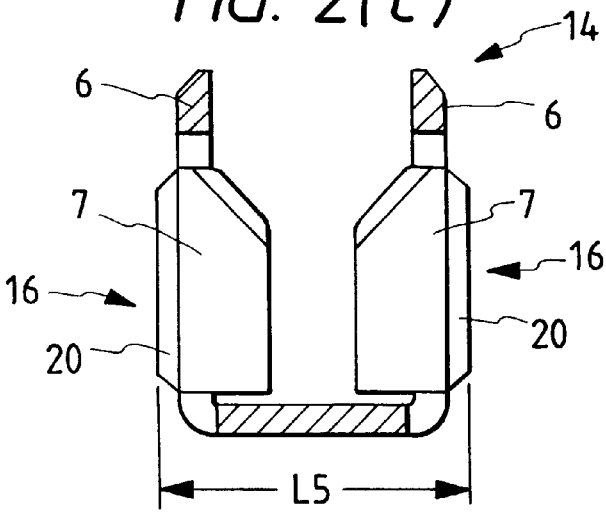
Figure 5:
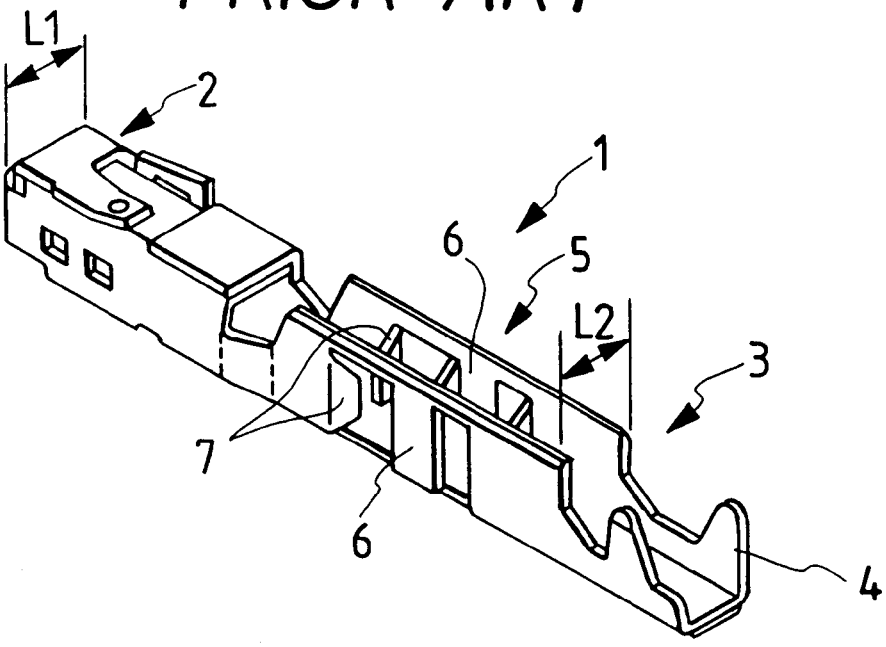
FIG. 5 PRIOR ART
FIG. 5 is a perspective view of a conventional press-connecting terminal.
Figure 6:
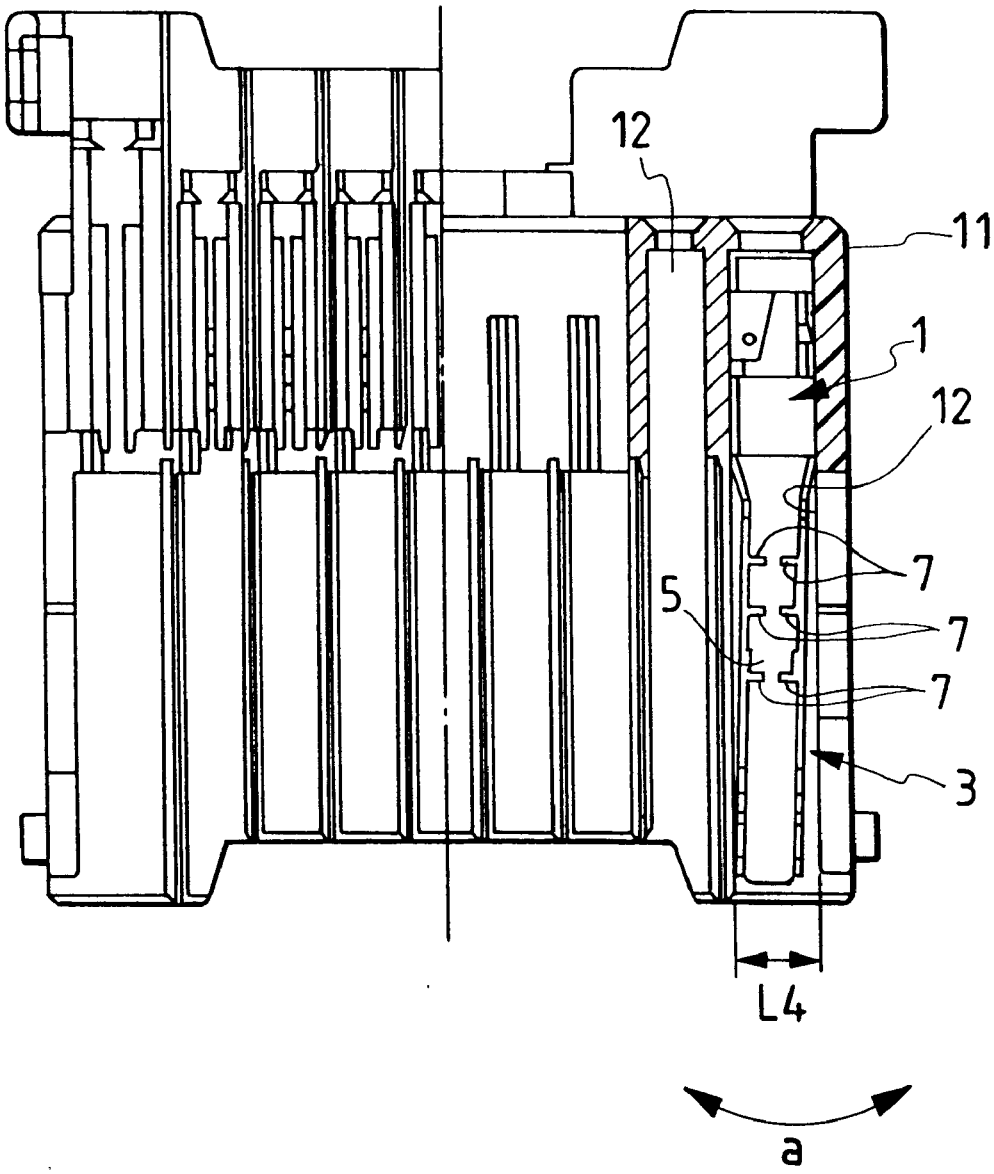
FIG. 6 PRIOR ART
FIG. 6 is a partially exploded plan view showing a state that the conventional press-connecting terminal is accommodated in the terminal accommodating groove of a housing.
Figure 7:
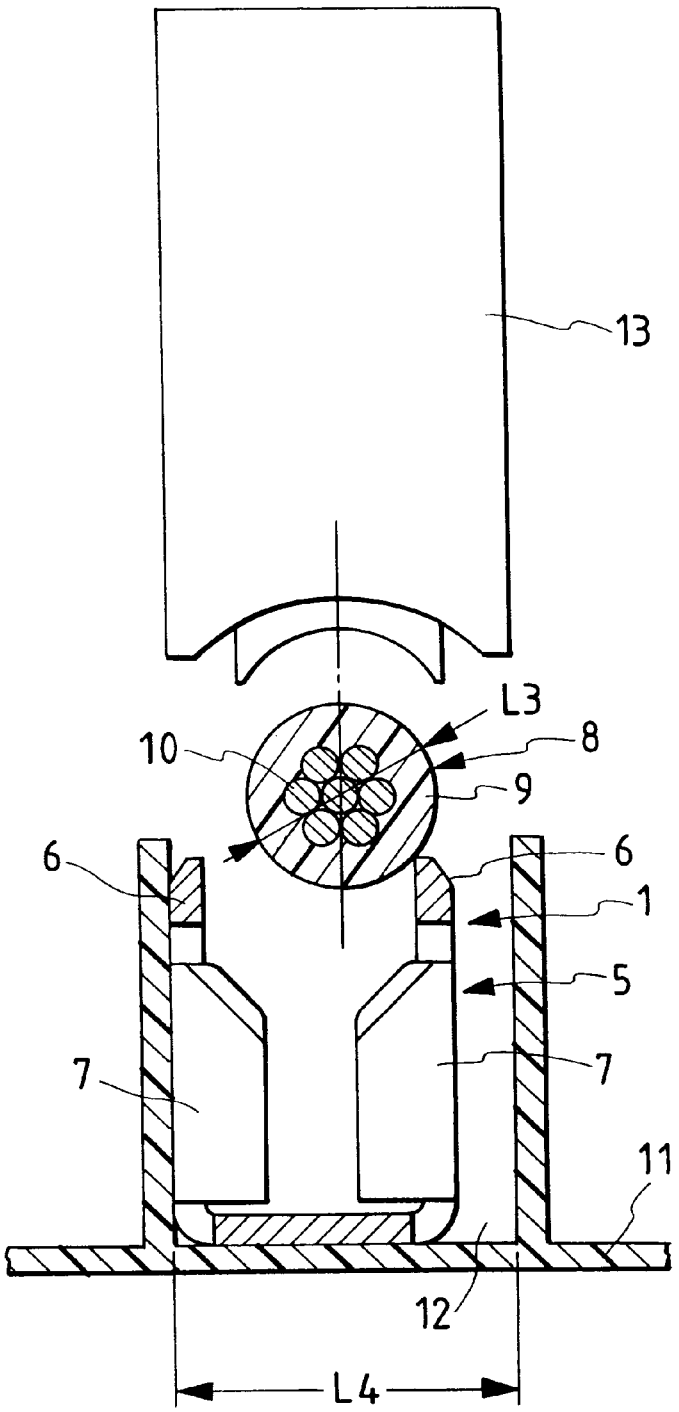
FIG. 7 PRIOR ART
FIG. 7 is a sectional view showing a state that the conventional press-connecting terminal is press-fitted in the terminal accommodating groove of the housing by means of a press-connecting jig.

A press-connecting terminal embodying the present invention will subsequently be described. FIG. 1(*a*) is a perspective view showing the relation among a press-connecting terminal 14, a covered electric wire 8 whose end portion is to be press-connected to the press-connecting terminal 14, and a press-connecting jig 13 used for press-connecting the end portion of the covered electric wire 8 to the press-connecting terminal 14; and FIG. 1(*b*) is a sectional view showing a state in which the covered electric wire 8 is to be press-connected to the press-connecting terminal 14 accommodated in a terminal accommodating groove 12 of a housing 11. Further, FIG. 2(*a*) is a side view of the press-connecting terminal 14; FIG. 2(*b*) is a plan view thereof; and FIG. 2(*c*) is a sectional view taken along line C—C of FIG. 2(*b*). Like reference characters are given to like component parts of the press-connecting terminal 1 shown in FIG. 5 and the description thereof will be omitted.

As shown in FIGS. 1(*a*), 1(*b*), 2(*a*), 2(*b*), and 2(*c*), positioning projections 16, 16 for positioning a press-connecting portion 15 in a predetermined position in the width direction of the terminal accommodating groove 12 are provided in the press-connecting portion 15 of the press-connecting terminal 14. The positioning projections 16, 16 have a pair of embossed detents 20, 20 which extend out toward an electric-wire holding portion 4 of a pair of sidewalls 6, 6, and the width L5 between the pair of embossed detents 20, 20 is set to be equal to the width L1 of a contact portion 2. The pair of embossed detents 20, 20 extend out to an extent exceeding the thickness of the plate material of the press-connecting terminal 14.

Therefore, the width L5 between the embossed detents 20, 20 is set to be substantially equal to the inside width L4 of the terminal accommodating groove 12, whereby the press-connecting terminal 14 is accommodated in the terminal accommodating groove 12 without a backlash.

Figure 3A:
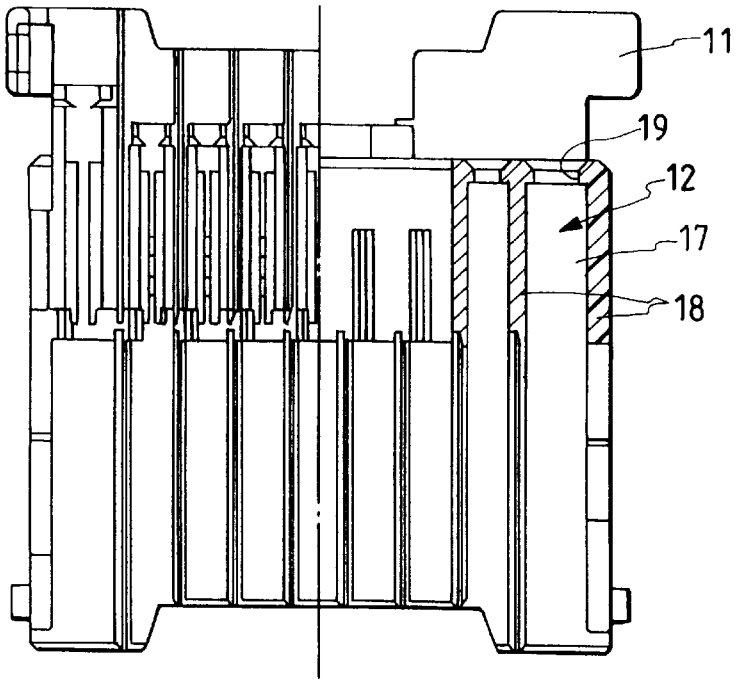
FIG. 3(*a*) is a partially exploded plan view of a housing in which the press-connecting terminal according to the present invention is accommodated in such a state that the press-connecting terminal is not accommodated in a terminal accommodating groove.
Figure 3B:
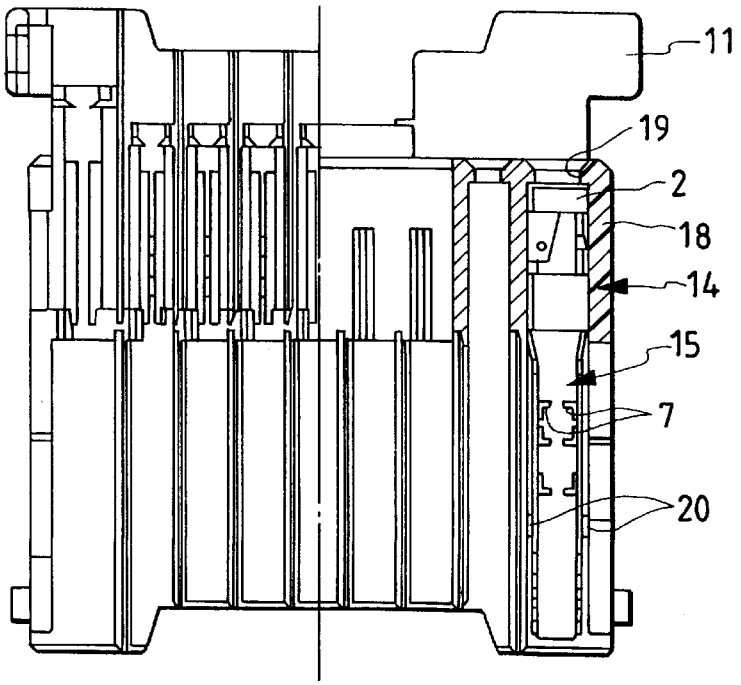

On the other hand, a plurality of rows of terminal accommodating grooves 12 are formed in the housing 11 accommodating the press-connecting terminal 14 as shown in FIG. 3(*a*). The terminal accommodating groove 12 is formed with a bottom wall 17 and opposed sidewalls 18, 18, the upper side (this side in FIG. 3(*a*)) and the rear end side being opened. Moreover, an opening 19 through which a mating terminal (not shown) is passed is formed on the front end side. The width inside the sidewalls 18, 18 is set to be substantially equal to or slightly larger than the width L1 of the contact portion 2 so that the contact portion 2 of the press-connecting terminal 14 can be accommodated with any backlash.

When the press-connecting terminal 14 is inserted in the terminal accommodating groove 12 in such a way that the contact portion 2 is situated on the side of the opening 19 as shown in FIG. 3(*b*), the embossed detents 20, 20 are brought into contact with the respective inner face sides of the sidewalls 18, 18 as shown in FIG. 1(*b*). The press-connecting terminal 14 is accommodated in the terminal accommodating groove 12 without the backlash in this state.

The end portion of the covered electric wire 8 is placed on the press-connecting portion 15 after the press-connecting terminal 14 is accommodated in the terminal accommodating groove 12, and then pressed by the press-connecting jig 13 from above. When the end portion of the covered electric wire 8 is pressed by the press-connecting jig 13, a covering portion 9 of the covered electric wire 8 kept in contact with the press-connecting blades 7, 7 is ruptured and a conductor portion 10 is electrically connected to the press-connecting blades 7, 7. Moreover, the covering portion of the covered electric wire 8 which is not in contact with the press-connecting blades 7, 7 is inserted in between the pair of sidewalls 6, 6.

Since the embossed detents 20, 20 are thus brought into contact with the inner faces of the sidewalls 18, 18 of the terminal accommodating groove 12 when the press-connecting terminal 14 is inserted in the terminal accommodating groove 12, the press-connecting terminal 14 is placed in a predetermined position in the width direction of the terminal accommodating groove 12. Moreover, the backlash of the press-connecting terminal 14 in the terminal accommodating groove 12 is prevented.

Since the press-connecting terminal 14 is placed in the predetermined position in the width direction of the terminal accommodating groove 12 (the central position in the width direction of the terminal accommodating groove 12 in this embodiment of the present invention), the press-connecting jig 13 is set to be free from interfering with the sidewalls 6, 6 and the press-connecting terminal 14 is not damaged when the end portion of the covered electric wire 8 is pressed by the press-connecting jig 13.

Figure 4:
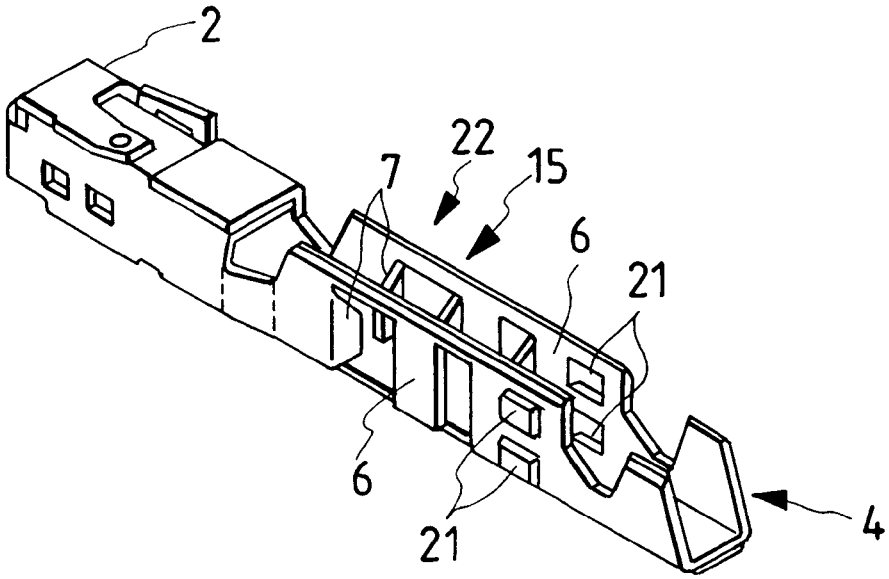
FIG. 4 is a perspective view of another press-connecting terminal embodying the present invention.

A description will subsequently be given of another press-connecting terminal embodying the present invention with reference to FIG. 4. A pair of overhanging elastic projections 21, 21 are cut and raised outward from the pair of sidewalls 6, 6 in order to form positioning projections in the press-connecting portion 15 of a press-connecting terminal 22 as shown in FIG. 4. These overhanging projections 21, 21 are formed at two levels on the respective sidewalls 6, 6. The width between the overhanging projections 21, 21 is set to be substantially equal to or slightly larger than the width L1 of the contact portion 2.

When the press-connecting terminal 22 is accommodated in the terminal accommodating groove 12, the overhanging projections 21, 21 are brought into contact with the respective inner faces of the sidewalls 18, 18 and place the press-connecting terminal 22 in a predetermined position in the width direction of the terminal accommodating groove 12 (the central position in the width direction of the terminal accommodating groove 12 likewise even according to this embodiment of the present invention as in the preceding embodiment thereof). As in the preceding embodiment of the present invention, the press-connecting terminal 22 is prevented from undergoing a backlash in the terminal accommodating groove 12 and when the end portion of the covered electric wire 8 is press-fitted in between the press-connecting blades 7, 7 by means of the press-connecting jig 13, the press-connecting jig 13 is not caused to interfere with the sidewalls 6, 6. Thus, the press-connecting terminal 22 is not damaged.

Although the width between the overhanging projections 21, 21 is set to be substantially equal to or slightly larger than the width L1 of the contact portion 2 in the press-connecting terminal 22 according to this embodiment of the present invention as shown in FIG. 4, the width between the overhanging projections 21, 21 may be set to be larger than the width L1 of the contact portion 2 by making the overhanging quantity of the overhanging projections 21, 21 larger than what is described in this embodiment. In this case, the overhanging projections 21, 21 are inserted while being bent toward the sidewalls 6, 6 when the press-connecting terminal 22 is accommodated in the terminal accommodating groove 12. In such a state that the press-connecting terminal 22 has been accommodated in the terminal accommodating groove 12, the press-connecting terminal 22 is accommodated in the terminal accommodating groove 12 without a backlash due to the elastic force of the overhanging projections 21, 21.

As described above, according to the present invention, the positioning projections of the press-connecting portion are brought into contact with the respective inside walls of the terminal accommodating groove and place the press-connecting terminal in the predetermined position in the width direction of the terminal accommodating groove when the press-connecting terminal is accommodated in the terminal accommodating groove of the housing. Therefore, the press-connecting terminal is prevented from undergoing a backlash in the terminal accommodating groove, and the press-connecting jig for use in pressing the covered electric wire into the gap between the pair of press-connecting blades is also prevented from interfering with the press-connecting terminal. Consequently, the press-connecting terminal is not damaged by the press-connecting jig.

What is claimed is:

1. A press-connecting terminal which is to be accommodated in a terminal accommodating groove formed in a housing, said press-connecting terminal comprising:

a press-connecting portion having a pair of opposed sidewalls and a pair of press-connecting blades which are respectively cut from said sidewalls and bent toward a space between said pair of opposed sidewalls and face each other with a predetermined gap held therebetween into which a covered electric wire is pressed;

a contact portion having a width larger than a width between the sidewalls of said press-connecting portion and which is to be connected to a mating terminal, the width of said contact portion being substantially equal to an inside width of the terminal accommodating groove of the housing; and a positioning projection protruding outwardly from at least one of said opposed sidewalls of said press-connecting portion for placing said press-connecting portion in a predetermined position in a width direction of the terminal accommodating groove, wherein said positioning projection includes at least one overhanging elastic projection which is cut and raised outward from each of the pair of sidewalls.

2. The press-connecting terminal as claimed in claim 1, wherein said positioning projection includes an embossed detent which extends from each said sidewalls, and a width between said embossed detents is equal to the width of said contact portion.

3. The press-connecting terminal as claimed in claim 1, wherein a width between said overhanging projection extending from a first of said sidewalls and said overhanging projection extending from a second of said sidewalls is set to be larger than the width of said contact portion, and each said overhanging projection is brought into elastic contact with respective inside walls of the terminal accommodating groove.

* * * * *